US006882318B2

(12) United States Patent
Nevermann

(10) Patent No.: US 6,882,318 B2
(45) Date of Patent: Apr. 19, 2005

(54) BROADBAND PLANAR INVERTED F ANTENNA

(75) Inventor: Peter Nevermann, San Diego, CA (US)

(73) Assignee: Siemens Information & Communications Mobile, LLC, San Diego, CA (US)

( * ) Notice: Subject to any disclaimer, the term of this patent is extended or adjusted under 35 U.S.C. 154(b) by 100 days.

(21) Appl. No.: 10/091,619

(22) Filed: Mar. 4, 2002

(65) Prior Publication Data

US 2003/0164798 A1 Sep. 4, 2003

(51) Int. Cl.[7] ..... H01Q 1/24
(52) U.S. Cl. ..... 343/702; 343/700 MS
(58) Field of Search ..... 343/700 MS, 846, 343/848, 829, 830, 702, 725, 729

(56) References Cited

U.S. PATENT DOCUMENTS

| | | | | |
|---|---|---|---|---|
| 6,121,930 | A * | 9/2000 | Grangeat et al. | 343/700 MS |
| 6,140,967 | A | 10/2000 | Kolsrud | 343/700 MS |
| 6,204,826 | B1 | 3/2001 | Rutkowski et al. | 343/895 |
| 6,218,991 | B1 | 4/2001 | Sanad | 343/700 MS |
| 6,281,850 | B1 | 8/2001 | Klostermann | 343/702 |
| 6,380,895 | B1 | 4/2002 | Moren et al. | |
| 6,380,903 | B1 * | 4/2002 | Hayes et al. | 343/725 |
| 6,417,816 | B1 | 7/2002 | Sadler et al. | |
| 6,459,413 | B1 | 10/2002 | Tseng et al. | 343/702 |
| 6,498,586 | B1 * | 12/2002 | Pankinaho | 343/700 MS |
| 6,504,511 | B1 | 1/2003 | Andersson | 343/702 |
| 6,518,937 | B1 | 2/2003 | Fang | 343/895 |
| 6,529,170 | B1 | 3/2003 | Nishizawa et al. | 343/795 |
| 2003/0160727 | A1 | 8/2003 | Ebine et al. | |

FOREIGN PATENT DOCUMENTS

| | | |
|---|---|---|
| DE | 199 29 689 | 1/2001 |
| WO | WO 00/16439 | 3/2000 |

OTHER PUBLICATIONS

Massey, P.J. (of Phillips Research Labs, Redhill, United Kingdom), "Fabric Antennas for Mobile Telephony Integrated Within Clothing", University College London's 2000 London Communications Symposium paper in Session 9 (website ee.ucl.ac.uk/lcs/papers2000).

FEKO; Mobile Phone Analysis; EMSS–SA (Pty) Ltd. Technopark, Stellenbosch, South Africa, 2000 publication.

* cited by examiner

*Primary Examiner*—James Clinger

(57) ABSTRACT

A mono-band planar inverted F antenna (PIFA) structure comprises a planar radiating element having a first area, and a ground plane having a second area that is substantially parallel to the radiating element first area. An electrically conductive first line is coupled to the radiating element at a first contact located at an edge on a side of the radiating element. The first line is also coupled to the ground plane. An electrically conductive second line is coupled to the radiating element at second and third contacts located along the same side as the first line, but at different locations on the edge than the first contact. Useable bandwidth of the PIFA is increased by using multiple contact locations to couple the conductive second line to the radiating element. The first and second lines are adapted to couple to a desired impedance, e.g., 50 ohms, at frequencies of operation of the PIFA.

26 Claims, 4 Drawing Sheets

FIG. 1 (Prior Technology)

BROADBAND PLANAR INVERTED F ANTENNA

BACKGROUND OF THE INVENTION

The present invention relates generally to antennas and more particularly to a broader bandwidth isotropic planar inverted F antenna.

Planar inverted F antennas (PIFAs) are used in wireless communications, e.g., cellular telephones, wireless personal digital assistants (PDAs), wireless local area networks (LANs)—Bluetooth, etc. The PIFA generally includes a planar radiating element having a first area, and a ground plane having a second area that is parallel to the radiating element first area. An electrically conductive first line is coupled to the radiating element at a first contact located at an edge on a side of the radiating element. The first line is also coupled to the ground plane. An electrically conductive second line is coupled to the radiating element along the same side as the first line, but at a different contact location on the edge than the first line. The first and second lines are adapted to couple to a desired impedance, e.g., 50 ohms, at frequencies of operation of the PIFA. In the PIFA, the first and second lines are perpendicular to the edge of the radiating element to which they are coupled, thereby forming an inverted F shape (thus the descriptive name of planar inverted F antenna).

The resonance frequency of the PIFA is determined, generally, by the area of the radiating element and to a lesser extent the distance between the radiating element and the ground plane (thickness of the PIFA assembly). The bandwidth of the PIFA is generally determined by thickness of the PIFA assembly and the electrical coupling between the radiating element and the ground plane. A significant problem in designing a practical PIFA application is the trade off between obtaining a desired operating bandwidth and reducing the PIFA volume (area×thickness). Furthermore, it is preferably that a larger ground plane area (shield) helps in reducing radio frequency energy that may enter into a user's head (SAR value=specific absorption rate), e.g., from a mobile cellular telephone. However, the volume of the PIFA increases with a larger ground plane area unless the thickness (distance between the radiating element and ground plane areas) is reduced.

As the number of wireless communications applications increase and the physical size of wireless devices decrease, antennas for these applications and devices are needed. Prior known planar inverted F antennas have sacrificed bandwidth by requiring a reduction in the volume (thickness) of the PIFA for a given wireless application.

Therefore, there is a need for improving the bandwidth of a PIFA without having to increase the volume (thickness) thereof.

SUMMARY OF THE INVENTION

The present invention overcomes the above-identified problems as well as other shortcomings and deficiencies of existing technologies by providing an apparatus, system and method for increasing the useable bandwidth of a PIFA without having to increase the volume (thickness) thereof.

According to an exemplary embodiment of the invention, a mono-band PIFA structure includes a planar radiating element having a first area, and a ground plane having a second area that is substantially parallel to the radiating element first area. An electrically conductive first line is coupled to the radiating element at a first contact located at an edge on a side of the radiating element. The first line is also coupled to the ground plane. An electrically conductive second line is coupled to the radiating element at second and third contacts located along the same side as the first contact, but at different locations on the edge than the first contact. The first and second lines are adapted for a desired impedance, e.g., 50 ohms, at frequencies of operation of the PIFA.

A more complete understanding of the specific embodiments of the present invention and advantages thereof may be acquired by referring to the following description taken in conjunction with the accompanying drawings.

DETAILED DESCRIPTION OF THE SPECIFIC EMBODIMENTS

Figure 1:
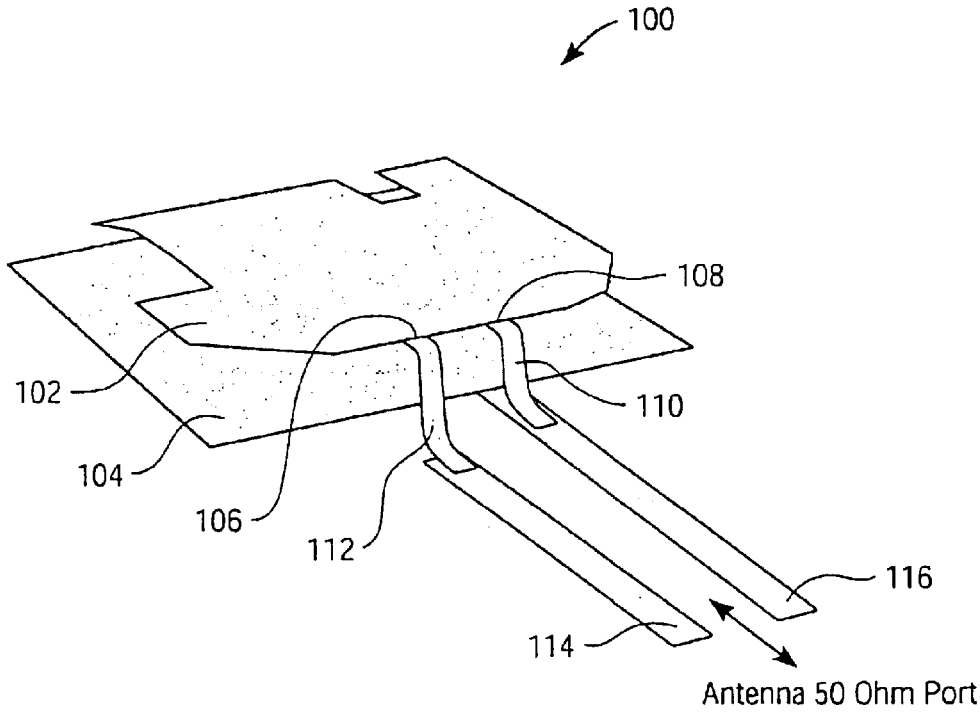
FIG. 1 is a schematic diagram of a prior technology planar inverted F antenna (PIFA)

According to an exemplary embodiment of the invention, a mono-band PIFA structure includes a planar radiating element having a first area, and a ground plane having a second area that is substantially parallel to the radiating element first area. An electrically conductive first line is coupled to the radiating element at a first contact located at an edge on a side of the radiating element. The first line is also coupled to the ground plane. An electrically conductive second line is coupled to the radiating element at second and third contacts located along the same side as the first contact, but at different locations on the edge than the first contact. The first and second lines are adapted for a desired impedance, e.g., 50 ohms, at frequencies of operation of the PIFA.

In accordance to the present invention, connecting the second line to the radiating element at more than one contact location results in enhanced bandwidth for a give volume PIFA structure. The additional contact location(s) are within the unchanged volume of the PIFA, thereby resulting in a better bandwidth to volume ratio, e.g., greater bandwidth from a thinner PIFA structure.

It is contemplated and within the scope of the invention that a plurality of contacts at different locations may be used to electrically couple a transmission line to one or more edges of the radiating element area of the PIFA. In addition, the PIFA structure (e.g., ground plane and radiating element), according to the present invention, is not restricted to any one shape, size and/or form. The ground plane and radiating element may be made of any type of conducting material, e.g., metal, graphite impregnated cloth, film having a conductive coating thereon, etc. The distance between the radiating element and the ground plane also need not be constant in some embodiments. The multiple contact location embodiments of the present invention may also be used effectively in planar structures for push bend antenna configurations without an increase in fabrication costs. At least one opening in the radiating element and/or the ground plane may be used for attachment of at least one mechanical support, e.g., spacers or support structure for the radiating element and/or ground plane.

The present invention is directed to an antenna comprising: a ground plane having a first planar surface and a first area; a radiating element having a second planar surface and a second area, wherein the second planar surface of the radiating element is substantially in parallel with the first planar surface of the ground plane; a first connecting line coupled to a first edge of the ground plane and to a second edge of the radiating element at a first contact location; and a second connecting line coupled to the second edge of the radiating element at second and third contact locations. The first area of the ground plane may be greater than the second area of the radiating element, or the first area of the ground plane area may be substantially the same as the second area of the radiating element. The first contact location may be between the second and third contact locations. The second connecting line may be coupled to the second edge of the radiating element at a plurality of contact locations. The first and second connecting lines may be adapted for a desired impedance. The desired impedance may be about 50 ohms. The desired impedance may be from about 50 ohms to about 75 ohms in some embodiments. The desired impedance may be from about 20 ohms to about 300 ohms in other embodiments. The radiating element and ground plane are made of an electrically conductive material. The electrically conductive material may be selected from the group consisting of copper, aluminum, stainless steel, bronze and alloys thereof, copper foil on a insulating substrate, aluminum foil on a insulating substrate, gold foil on a insulating substrate, silver plated copper, silver plated copper foil on a insulating substrate, silver foil on a insulating substrate and tin plated copper, graphite impregnated cloth, a graphite coated substrate, a copper plated substrate, a bronze plated substrate and an aluminum plated substrate, according to various specific embodiments. The ground plane may be on one side of an insulating substrate and the radiating element may be on the other side of the insulating substrate. The ground plane, the insulating substrate and the radiating element may be flexible. The first area of the ground plane and the second area of the radiating element may be rectangular or non-rectangular.

The present invention is also directed to a planar inverted F antenna comprising: a ground plane having a first planar surface and a first area; a radiating element having a second planar surface and a second area, wherein the second planar surface of the radiating element may be substantially in parallel with the first planar surface of the ground plane; a first connecting line coupled to an edge of the ground plane and to an edge of the radiating element; and a second connecting line coupled to the edge of the radiating element on either side of where the first connecting line is coupled thereto.

The present invention is directed to a planar inverted F antenna comprising: a ground plane having a first planar surface, a first circumference and a first plurality of edges on the first circumference; a radiating element having a second planar surface, a second circumference and a second plurality of edges on the second circumference, the second planar surface of the radiating element being substantially in parallel with the first planar surface of the ground plane; a first connecting line coupled to a first edge of the first plurality of edges and a first edge of the second plurality of edges; and a second connecting line coupled to the first edge of the second plurality of edges on either side of the first connecting line.

The present invention is also directed to a method for fabricating a wide bandwidth planar inverted F antenna, comprising the steps of: forming a ground plane on a first planar surface; forming a radiating element on a second planar surface, wherein the second planar surface is substantially in parallel with the first planar surface; coupling a first connecting line to a first edge of the ground plane and to a second edge of the radiating element at a first contact location; and coupling a second connecting line to the second edge of the radiating element at second and third contact locations. The first contact location may be between the second and third contact locations. The step of coupling may further comprise the step of coupling the second connecting line to the second edge of the radiating element at a plurality of contact locations.

The present invention is also directed to a radio system having a planar inverted F antenna (PIFA), the radio system comprises a ground plane having a first planar surface and a first area; a radiating element having a second planar surface and a second area, wherein the second planar surface of the radiating element is substantially in parallel with the first planar surface of the ground plane; a first connecting line coupled to a first edge of the ground plane and to a second edge of the radiating element at a first contact location; and a second connecting line coupled to the second edge of the radiating element at second and third contact locations, and first and second connecting lines are adapted to couple to a radio at a desired impedance.

A technical advantage of the present invention is increased bandwidth without increased volume. Another technical advantage is reducing specific absorption rate by increasing ground plane area without increasing the volume of a PIF antenna. Another technical advantage is greater bandwidth resulting in an antenna that is more insensitive to geometrical variations causing changes in antenna properties during manufacturing. Another technical advantage is less critical adjustment and manufacturing tolerances resulting in better yields in mass production.

The present invention may be susceptible to various modifications and alternative forms. Specific embodiments of the present invention are shown by way of example in the drawings and are described herein in detail. It should be understood, however, that the description set forth herein of specific embodiments is not intended to limit the present invention to the particular forms disclosed. Rather, all modifications, alternatives, and equivalents falling within the spirit and scope of the invention as defined by the appended claims are intended to be covered.

Referring now to the drawings, the details of an exemplary specific embodiment of the invention is schematically illustrated. Like elements in the drawings will be represented by like numbers, and similar elements will be represented by like numbers with a different lower case letter suffix.

FIG. 1 illustrates a schematic diagram of a prior technology planar inverted F antenna (PIFA). The prior technology PIFA is generally represented by the numeral 100. The PIFA 100 comprises a radiating element 102, a ground plane 104, a first connecting line 110 coupled to the radiating element 102 at contact location 108, and a second connecting line 112 coupled to the radiating element 102 at contact location 106. The first connecting line 110 is also coupled to the ground plane 104. The connecting lines 110 and 112 are adapted for coupling to a radio system (not shown) through connections 116 and 114 respectively. The connections 114 and 116, generally, are adapted for a desired impedance, e.g., 50 ohms, at frequencies of operation of the PIFA. The connection 114 is generally the "hot" connection and the connection 116 is generally the ground connection.

Figure 2:
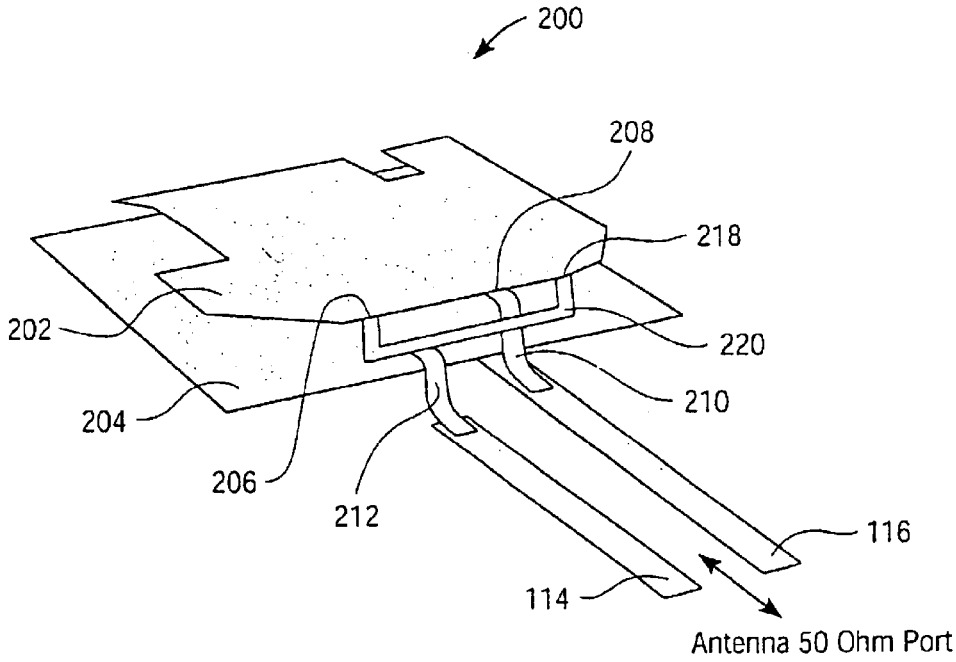
FIG. 2 is a schematic diagram of an exemplary embodiment of a planar inverted F antenna (PIFA), according to the present invention.

Referring to FIG. 2, depicted is a schematic diagram of an exemplary embodiment of a planar inverted F antenna (PIFA), according to the present invention. This specific exemplary embodiment of a PIFA is generally represented by the numeral 200. The PIFA 200 comprises a radiating element 202, a ground plane 204, a first connecting line 210 coupled to the radiating element 202 at contact location 208, and a second connecting line 212 coupled to a third connecting line 220 coupled to the radiating element 202 at contact locations 206 and 218. The first connecting line 210 is also coupled to the ground plane 204. The connecting lines 210 and 212 are adapted to be coupled to a radio system (not shown) through connections 116 and 114 respectively. The connections 114 and 116, generally, are adapted for a desired impedance, e.g., 20 ohms, 50 ohms, 75 ohms, or from about 20 to 300 ohms at frequencies of operation of the PIFA 200. The connection 114 is generally the "hot" connection, and the connection 116 is generally the ground connection. According to the invention, coupling to the radiating element 202 at multiple contact locations (206, 218) increases the bandwidth of the PIFA 200.

Increased bandwidth allows the radiating element 202 and ground plane 204 to be closer together (thinner), thus requiring less volume for the PIFA 200. It is contemplated and within the scope of the present invention that coupling to the radiating element 202 at more than two contact locations may be utilized for increased bandwidth of the PIFA 200, according to the present invention.

The ground plane 204 and/or the radiating element 202 may have an opening(s), e.g., holes or cutouts, therein for reduction of weight and/or attachment of mechanical support(s), e.g., dielectric insulating supports (not illustrated) holding the ground plane 204 and/or the radiating element 202.

The present invention is not restricted to any one shape, size and/or form. The ground plane 204 and radiating element 202 may be made of any type of conducting material, e.g., metal, metal alloys, graphite impregnated cloth, film having a conductive coating thereon, etc. The distance between the radiating element 202 and the ground plane 204 need not be constant. The multiple contact location embodiments of the present invention may also be used effectively in planar structures for push bend antenna configurations without an increase in fabrication costs.

Figure 3B:
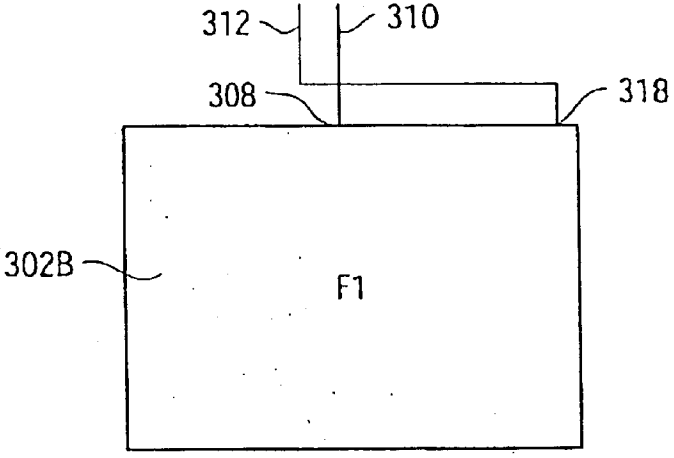
FIGS. 3A and 3B are schematic plan views of PIFA configurations having slightly different resonant frequencies of operation.
Figure 3A:
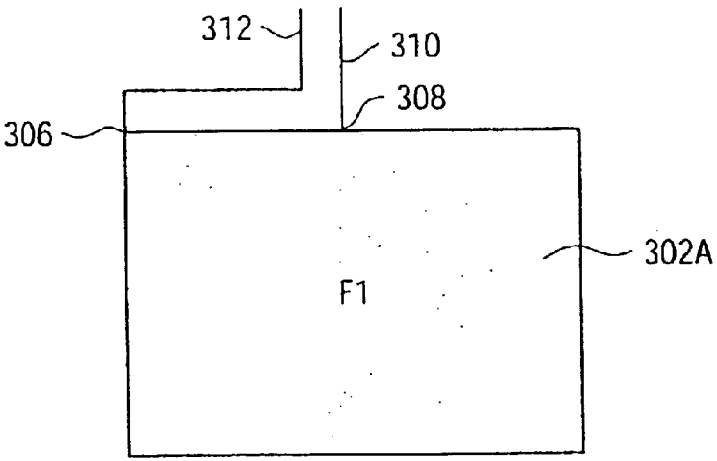

Referring to FIGS. 3A and 3B, depicted are schematic plan views of PIFA configurations having resonance at slightly different frequencies. The PIFA illustrated in FIG. 3A may have resonance at a first frequency and the PIFA illustrated in FIG. 3B may have resonance at a second frequency. The first and second resonance frequencies are slightly different. For example, the first frequency may be at about 1900 MHz and the second frequency may be at about 2100 MHz (PCS telephone). The radiating element 302A of the PIFA of FIG. 3A is the same as the radiating element 302B of the PIFA of FIG. 3B. The difference in resonance frequencies between these two PIFAs is due to the contact locations 306 and 318 being at different places on the radiating elements 302A and 302B, respectively.

Figure 3C:
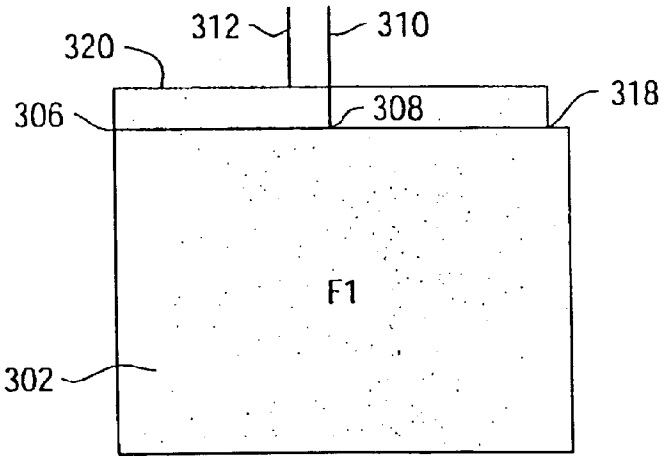
FIG. 3C is a schematic diagram of the PIFA configurations of FIGS. 3A and 3B combined into one broadband PIFA configuration, according to an exemplary embodiment of the present invention.

Referring now to FIG. 3C, depicted is a schematic diagram of the PIFA configurations of FIGS. 3A and 3B combined into one broadband PIFA configuration. When the two PIFA structures of FIGS. 3A and 3B are thereby combined, the bandwidth of the combination PIFA is increased without requiring separate radiating elements 302. A single set of connecting lines 310 and 312 may be used, wherein the connecting line 312 is coupled through connecting line 320 to the radiating element 302 at contact locations 306 and 318. The ground connecting line 310 remains as a common in the new PIFA structure. The combination of different contact locations (306, 318) on the radiating element 302 results in a multiple resonance, closely coupled, "stagger tuned" PIFA structure, whereby the resulting PIFA structure has wider bandwidth and is less critical to manufacture and utilize in a radio system, e.g., PCS.

Figure 4:
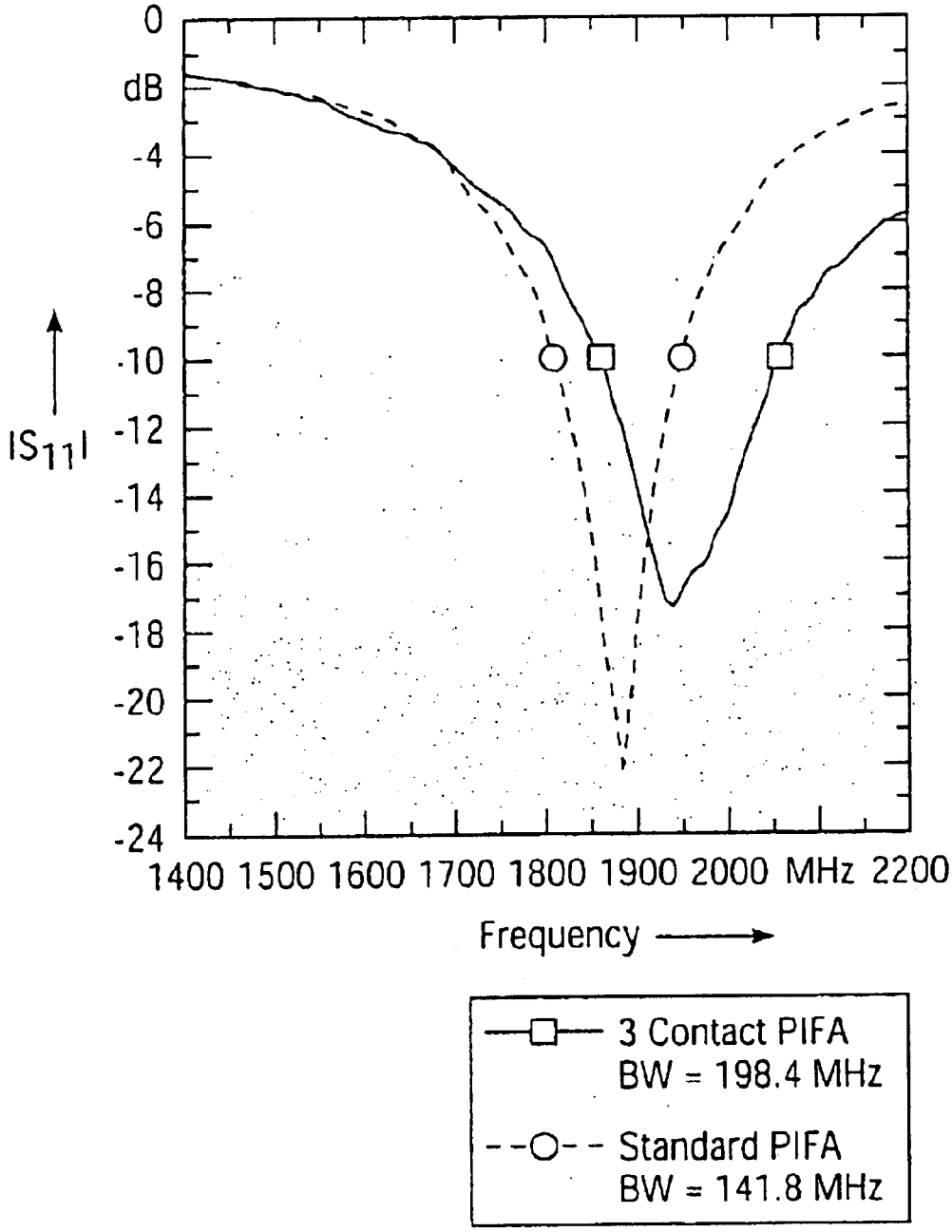
FIG. 4 shows the performance bandwidth improvement of a PIFA according to a specific embodiment of the present invention, in comparison to a prior art PIFA.

FIG. 4 shows the performance bandwidth improvement of a PIFA according to a specific embodiment of the present invention, in comparison to a prior art PIFA. This figure shows the performance improvement of the present improved PIFA structure with three feeding points over the conventional PIFA for (as merely an example) the PCS application which has a 140 MHz bandwidth requirement (1850–1990 MHz). FIG. 4 shows the magnitude of the input power reflection coefficient $S_{11}$ of the two antennas over frequency. As seen by the dotted line, the frequency bandwidth of the standard PIFA which has a bandwidth of 141.8 MHz and the solid line shows the frequency bandwidth of the three-contact PIFA according to a specific embodiment of the present invention which has a bandwidth of 198.4 MHz. This illustrates that the performance improvement is about 58 MHz for a specific embodiment of the invention (assuming a bandwidth determination at −10 dB).

The present invention has been described in terms of specific exemplary embodiments. In accordance with the present invention, the parameters for a system may be varied, typically with a design engineer specifying and selecting them for the desired application. Further, it is contemplated that other embodiments, which may be devised readily by persons of ordinary skill in the art based on the teachings set forth herein, may be within the scope of the invention, which is defined by the appended claims. The present invention may be modified and practiced in different but equivalent manners that will be apparent to those skilled in the art and having the benefit of the teachings set forth herein.

What is claimed is:

1. An antenna, comprising:

a ground plane having a first planar surface and a first area;

a radiating element having a second planar surface and a second area, wherein the second planar surface of said radiating element is substantially in parallel with the first planar surface of said ground plane;

a first connecting line coupled to a first edge of said ground plane and to a second edge of said radiating element at a first contact location; and a second connecting line coupled to the second edge of said radiating element at second and third contact locations.

2. The antenna according to claim 1, wherein the first area of said ground plane is greater than the second area of said radiating element.

3. The antenna according to claim 1, wherein the first area of said ground plane area is substantially the same as the second area of said radiating element.

4. The antenna according to claim 1, wherein the first contact location is between the second and third contact locations.

5. The antenna according to claim 1, further comprising the second connecting line being coupled to the second edge of said radiating element at a plurality of contact locations.

6. The antenna according to claim 1, wherein the first and second connecting lines are adapted for a desired impedance.

7. The antenna according to claim 6, wherein the desired impedance is about 50 ohms.

8. The antenna according to claim 6, wherein the desired impedance is from about 50 ohms to about 75 ohms.

9. The antenna according to claim 6, wherein the desired impedance is from about 20 ohms to about 300 ohms.

10. The antenna according to claim 1, wherein said radiating element is made of an electrically conductive material.

11. The antenna according to claim 10, wherein the electrically conductive material is selected from the group consisting of copper, aluminum, stainless steel, bronze and alloys thereof, copper foil on a insulating substrate, aluminum foil on a insulating substrate, gold foil on a insulating substrate, silver plated copper, silver plated copper foil on a insulating substrate, silver foil on a insulating substrate and tin plated copper, graphite impregnated cloth, a graphite coated substrate, a copper plated substrate, a bronze plated substrate and an aluminum plated substrate.

12. The antenna according to claim 1, wherein said ground plane is made of an electrically conducting material.

13. The antenna according to claim 12, wherein the electrically conductive material is selected from the group consisting of copper, aluminum, stainless steel, bronze and alloys thereof, copper foil on a insulating substrate, aluminum foil on a insulating substrate, gold foil on a insulating substrate, silver plated copper, silver plated copper foil on a insulating substrate, silver foil on a insulating substrate and tin plated copper, graphite impregnated cloth, a graphite coated substrate, a copper plated substrate, a bronze plated substrate and an aluminum plated substrate.

14. The antenna according to claim 1, wherein said ground plane is on one side of an insulating substrate and said radiating element is on the other side of the insulating substrate.

15. The antenna according to claim 14, wherein said ground plane, the insulating substrate and said radiating element are flexible.

16. The antenna according to claim 1, wherein the first area of said ground plane and the second area of said radiating element are rectangular.

17. The antenna according to claim 1, wherein the first area of said ground plane and the second area of said radiating element are non-rectangular.

18. The antenna according to claim 1, further comprising at least one opening in said radiating element for attachment of at least one mechanical support.

19. The antenna according to claim 1, further comprising at least one opening in said ground plane for attachment of at least one mechanical support.

20. A planar inverted F antenna, comprising:

a ground plane having a first planar surface and a first area;

a radiating element having a second planar surface, and a second area, wherein the second planar surface of said radiating element being substantially in parallel with the first planar surface of said ground plane;

a first connecting line coupled to an edge of said ground plane and to an edge of said radiating element;

a connecting bar coupled to the edge of said radiating element on both sides of said first connecting line, and a second connecting line coupled to the connecting bar.

21. A planar inverted F antenna, comprising:

a ground plane having a first planar surface, a first circumference and a first plurality of edges on the first circumference;

a radiating element having a second planar surface, a second circumference and a second plurality of edges on the second circumference, the second planar surface of said radiating element being substantially in parallel with the first planar surface of said ground plane;

a first connecting line coupled to a first edge of the first plurality of edges and a first edge of the second plurality of edges;

a connecting bar coupled to said first edge of the second plurality of edges on both sides of said first connecting line, and a second connecting line coupled to said connecting bar.

22. A method of fabricating a wide bandwidth planar inverted F antenna, comprising the steps of:

forming a ground plane on a first planar surface;

forming a radiating element on a second planar surface, wherein the second planar surface is substantially in parallel with the first planar surface;

coupling a first connecting line to a first edge of the ground plane and to a second edge of the radiating element at a first contact location; and coupling a second connecting line to the second edge of the radiating element at second and third contact locations.

23. The method according to claim 22, wherein the first contact location is between the second and third contact locations.

24. The method according to claim 22, further comprising the step of coupling the second connecting line to the second edge of said radiating element at a plurality of contact locations.

25. A radio system having a planar inverted F antenna (PIFA), said system comprising:

a ground plane having a first planar surface and a first area;

a radiating element having a second planar surface and a second area, wherein the second planar surface of said radiating element is substantially in parallel with the first planar surface of said ground plane;

a first connecting line coupled to a first edge of said ground plane and to a second edge of said radiating element at a first contact location; and a second connecting line coupled to the second edge of said radiating element at second and third contact locations, and first and second connecting lines are adapted to couple to a radio at a desired impedance.

26. A radio system of claim 25 wherein said radio system is part of a mobile phone system.

* * * * *